US008261406B2

(12) United States Patent
Kunz et al.

(10) Patent No.: US 8,261,406 B2
(45) Date of Patent: Sep. 11, 2012

(54) VACUUM WITH MULTIPLE EXHAUST POINTS

(75) Inventors: Michael P. Kunz, Hampstead, MD (US); Paul S. White, Towson, MD (US); Gregg L. Sheddy, Shrewsbury, PA (US)

(73) Assignee: Black & Decker Inc., Newark, DE (US)

( * ) Notice: Subject to any disclaimer, the term of this patent is extended or adjusted under 35 U.S.C. 154(b) by 565 days.

(21) Appl. No.: 12/246,521

(22) Filed: Oct. 7, 2008

(65) Prior Publication Data

US 2009/0095360 A1 Apr. 16, 2009

Related U.S. Application Data

(60) Provisional application No. 60/979,247, filed on Oct. 11, 2007.

(51) Int. Cl.
*A47L 5/00* (2006.01)
*A47L 9/00* (2006.01)

(52) U.S. Cl. ..... 15/326; 15/327.2

(58) Field of Classification Search ..... 15/326, 15/327.2

See application file for complete search history.

(56) References Cited

U.S. PATENT DOCUMENTS

| | | | | |
|---|---|---|---|---|
| 4,617,034 | A * | 10/1986 | Ikezaki et al. | 96/382 |
| 5,289,612 | A * | 3/1994 | Glenn, III | 15/326 |
| 5,513,417 | A * | 5/1996 | Kim et al. | 15/326 |
| 2006/0179601 | A1 * | 8/2006 | Crevling et al. | 15/326 |

* cited by examiner

*Primary Examiner* — Bryan R Muller

(74) *Attorney, Agent, or Firm* — Harness, Dickey & Pierce, P.L.C.

(57) ABSTRACT

A vacuum is provided with multiple exhaust points which provide for quieter, lower velocity discharge of the air from the vacuum source. The multiple exhaust points are supplied from a radially extending chamber that is defined between upper and lower panels. The radially extending chamber has both vertical and radial sections that operate to slow the velocity of the exhaust air to reduce the noise generated by the vacuum.

15 Claims, 9 Drawing Sheets

VACUUM WITH MULTIPLE EXHAUST POINTS

CROSS-REFERENCE TO RELATED APPLICATIONS

This application claims the benefit of U.S. Provisional Application No. 60/979,247, filed on Oct. 11, 2007. The entire disclosure of the above application is incorporated herein by reference.

FIELD

The present disclosure relates to a vacuum exhaust system, and more particularly, to a vacuum having multiple exhaust points.

BACKGROUND

The statements in this section merely provide background information related to the present disclosure and may not constitute prior art.

Vacuums, particularly industrial vacuums, are provided with a vacuum source including a motor and an impeller that draws air into a housing through an inlet port, through a filter and forces the air out through an exhaust port. The air passing through the outlet port can cause high noise levels as well as high velocity of airflow in one direction which can be disruptive to dust and debris near the vacuum.

SUMMARY

This section provides a general summary of the disclosure, and is not a comprehensive disclosure of its full scope or all of its features.

A vacuum is provided including a housing. A drive motor is disposed in the housing and includes a fan impeller attached to the drive motor and disposed in a fan chamber within the housing. An intake port extends into the housing. An exhaust system is in communication with the fan chamber and includes a plurality of exhaust openings in the housing.

Further areas of applicability will become apparent from the description provided herein. The description and specific examples in this summary are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
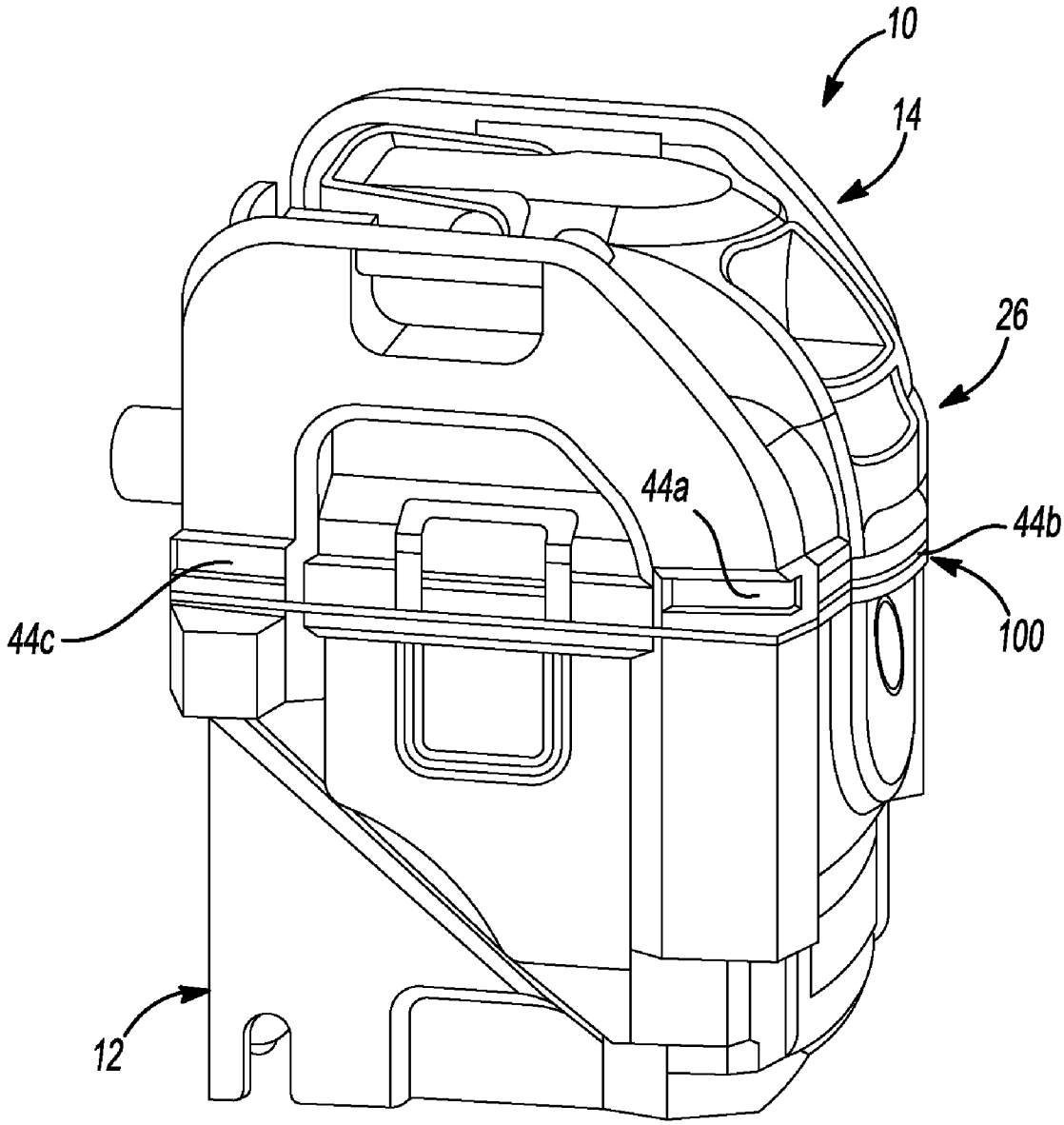
FIG. 1 is a perspective view of a shop vacuum incorporating a multi-point exhaust system according to the principles of the present disclosure.

The following description is merely exemplary in nature and is not intended to limit the present disclosure, application, or uses. It should be understood that throughout the drawings, corresponding reference numerals indicate like or corresponding parts and features.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
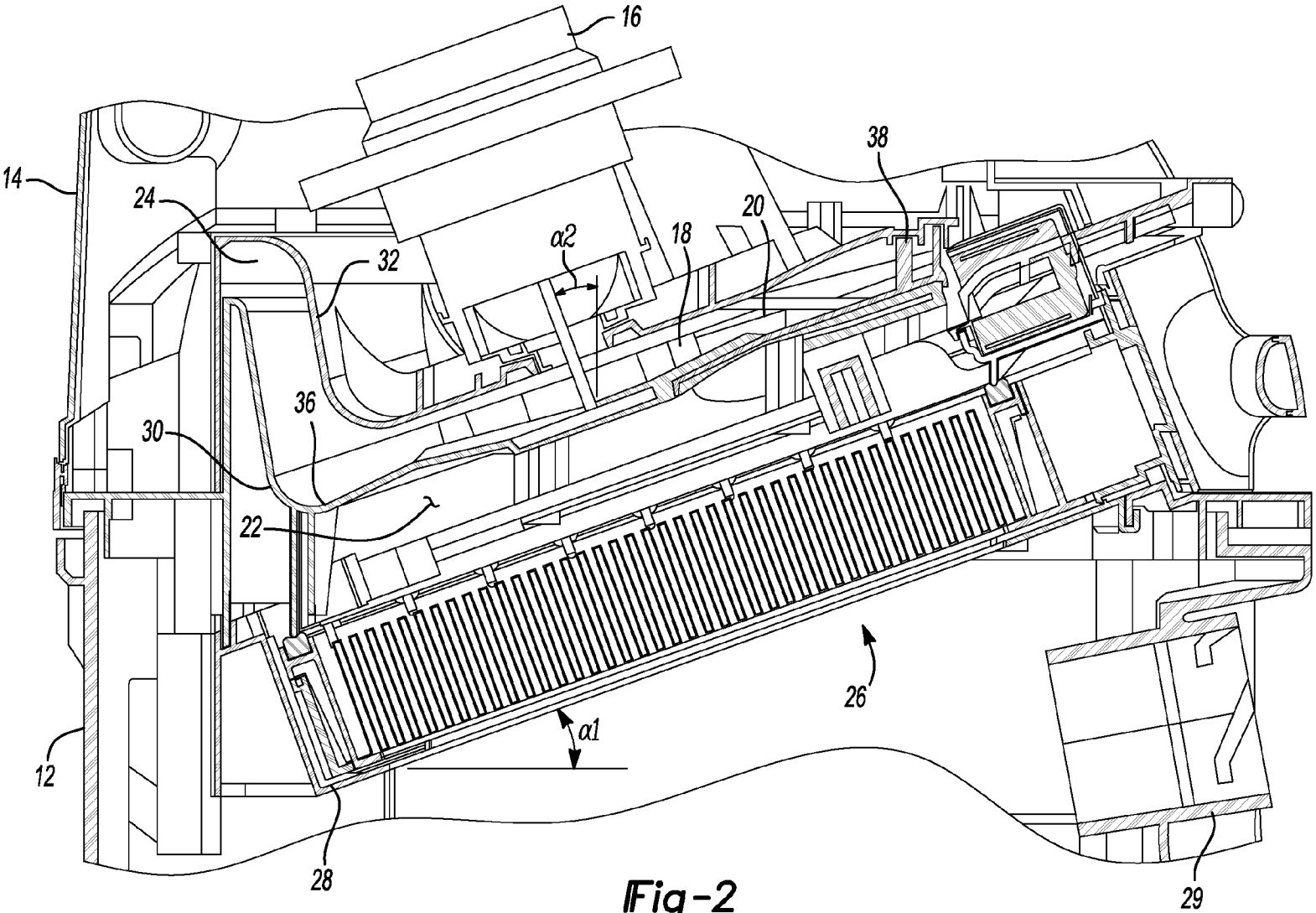
FIG. 2 is a partial cross-sectional view of the vacuum head according to the principles of the present disclosure.
Figure 3:
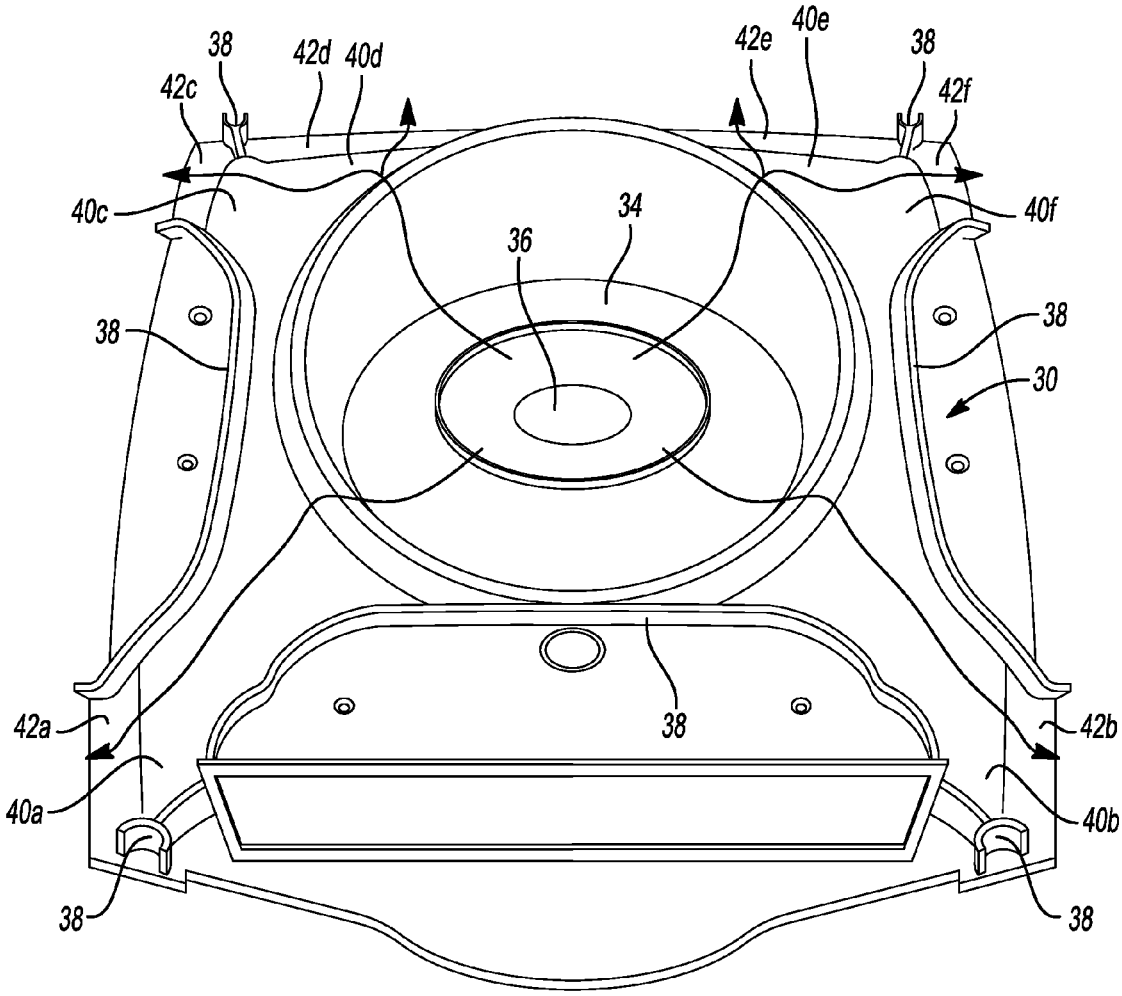
FIG. 3 is a front perspective view of a fan chamber lower panel according to the principles of the present disclosure.
Figure 4:
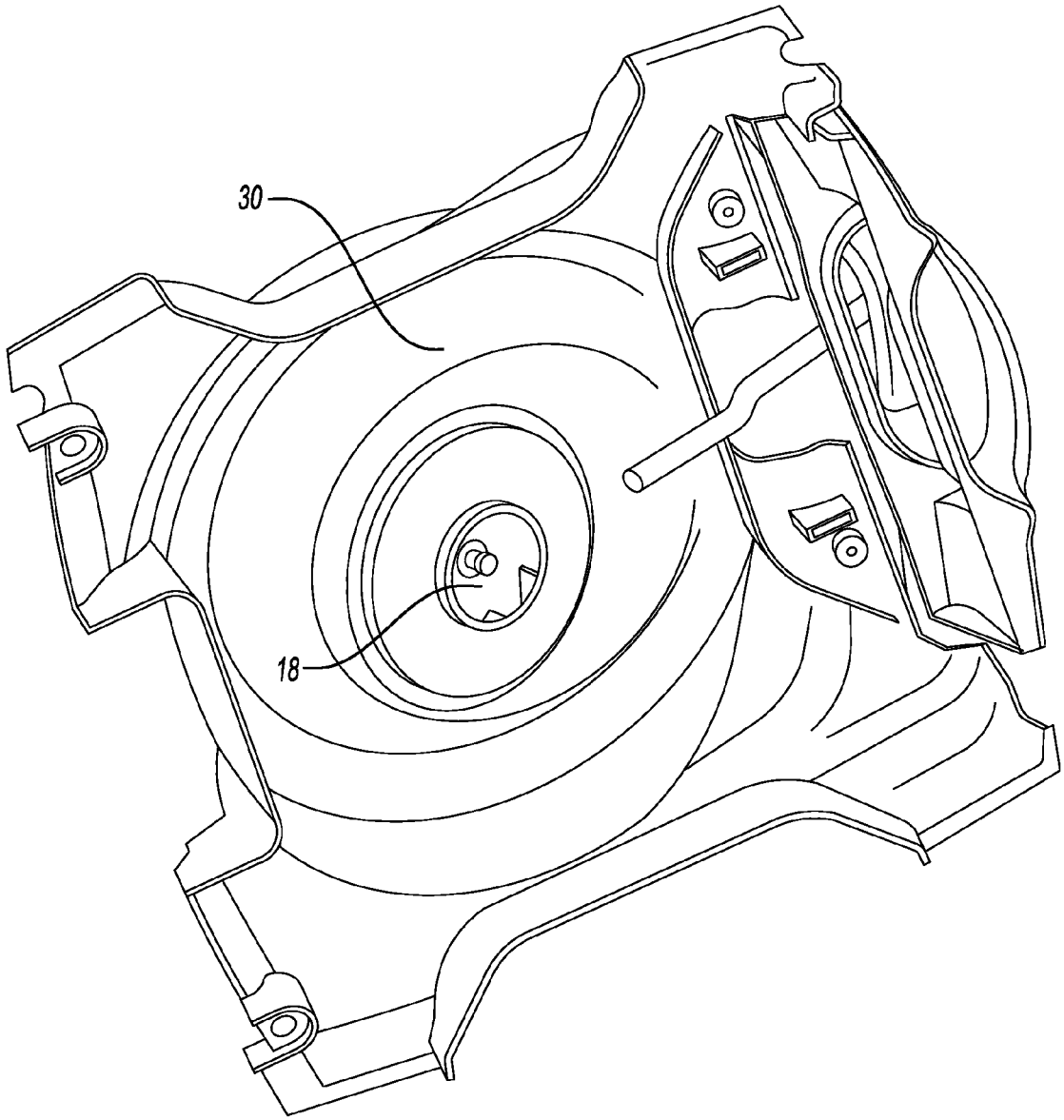
FIG. 4 is a bottom perspective view of the lower panel of the fan chamber.

With reference to FIGS. 1-3, an example vacuum 10 will be described. The vacuum 10 includes a canister 12 and a vacuum head 14 that closes the canister 12. As shown in FIG. 2, the vacuum head 14 may support a drive motor 16. The drive motor 16 may support a fan impeller 18, which may be provided in a fan chamber 20 of the vacuum head 14. The fan chamber 20 may be in fluid communication with an intake port 22 and an exhaust system 24. The intake port 22 may be covered by a filter assembly 26 situated in a filter housing 28 of the vacuum head 14. The canister 12 can include a suction inlet 29.

The motor 16, when powered up, may rotate the fan impeller 18 to draw air through the suction inlet 29 into the canister 12, from the canister 12 through the filter assembly 26, through the intake port 22 and into the fan chamber 20. The impeller fan 18 may push the air in the fan chamber 20 through the exhaust system 24 and out of the vacuum 10.

The fan chamber 20 can be defined by a lower panel 30 and an upper panel 32 which sandwich the fan impeller 18. As shown in FIG. 3, the lower panel 30 of the fan chamber 20 defines a generally centrally located recess 34 defining a lower wall of the fan chamber 20. A centrally located aperture 36 defines the air intake port 22 into the fan chamber 20. A series of perimeter walls 38 define a plurality of channels 40*a-f* leading to multiple corresponding exhaust points 42*a-f* of the exhaust system 24. The upper panel 32 engages an upper surface of walls 38 to enclose the channels 40*a-f* as illustrated in FIG. 2. The exhaust points 42*a-f* each correspond to an exhaust opening 44*a-f* provided in circumferentially spaced locations around said vacuum head 14, as shown in FIG. 1. The exhaust openings 44*a-f* can be disposed in the sides and back of the vacuum 10 so that the exhaust air is not directed to the front of the vacuum 10 where dirt and debris that is being picked up can be disturbed. Alternative arrangements of the exhaust openings 44*a-f* can be provided with the exhaust openings 44*a-f* on two or more sides of the housing and in the corners or in the centers thereof depending upon desired uses. The multiple exhaust points provide for quieter, lower velocity discharge of the air from the vacuum source.

As can be seen in FIG. 3, the lower panel 30 can define an access opening for the filter tray assembly 26 with channels 40*a*, 40*b* disposed on opposite sides thereof for discharge off to each side.

Figure 5:
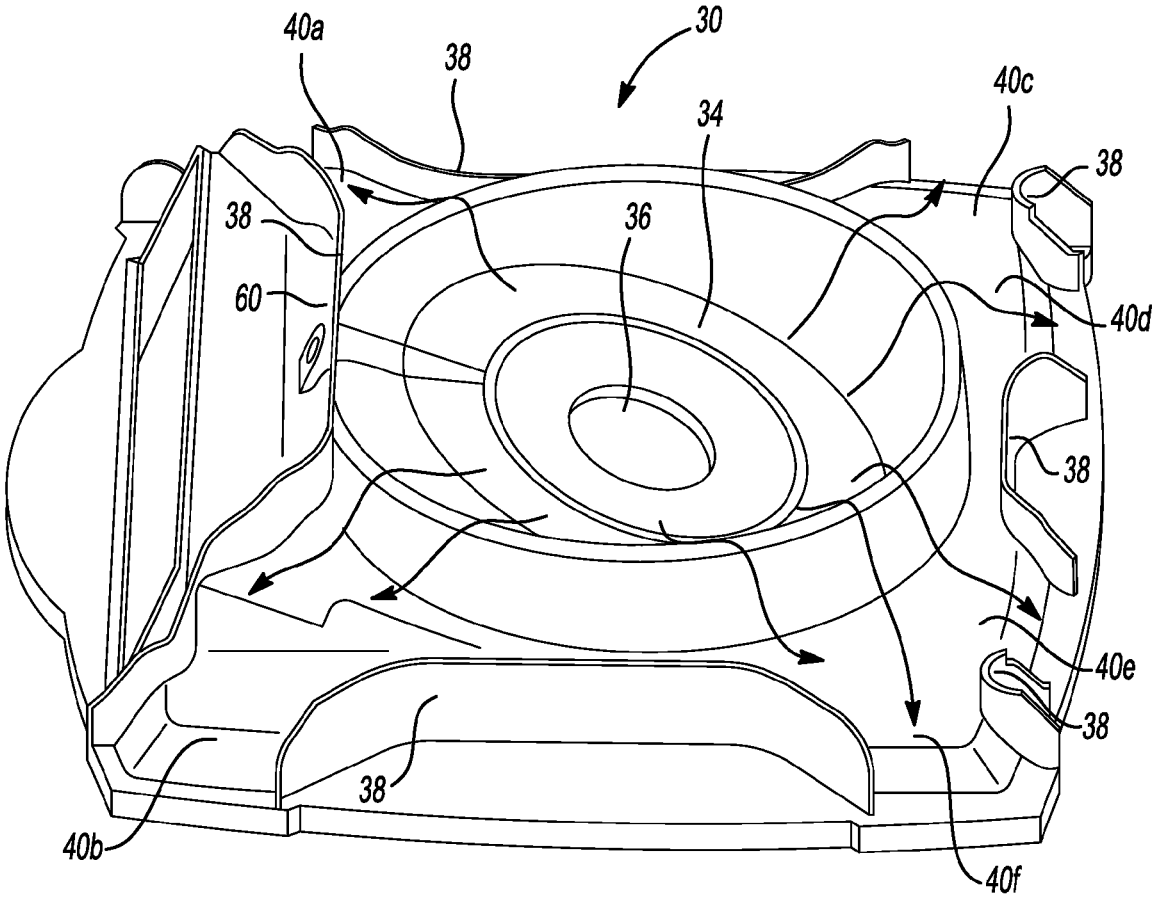
FIG. 5 is a side perspective view of the lower panel.
Figure 6:
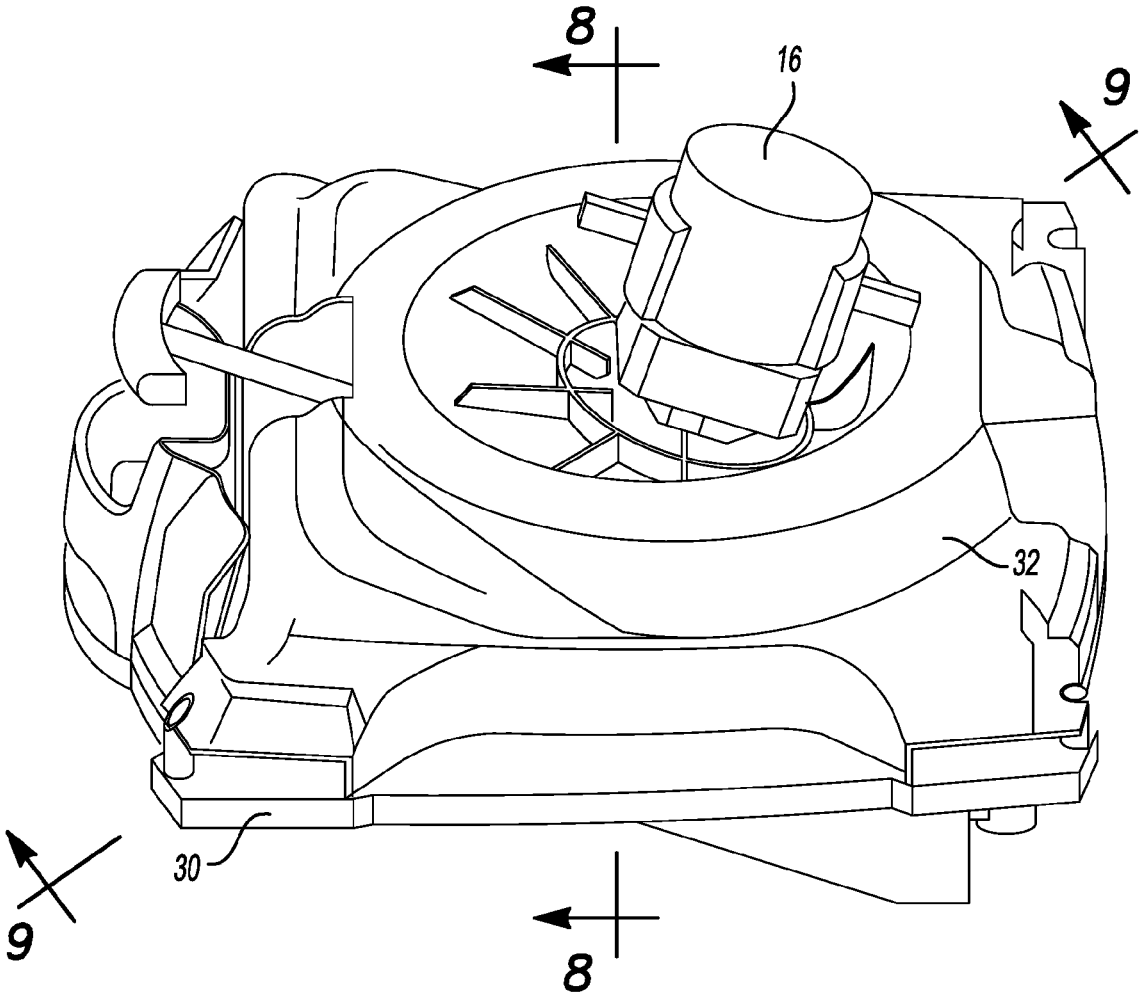
FIG. 6 is a perspective view of a motor assembly mounted to the upper panel of the fan chamber.
Figure 7:
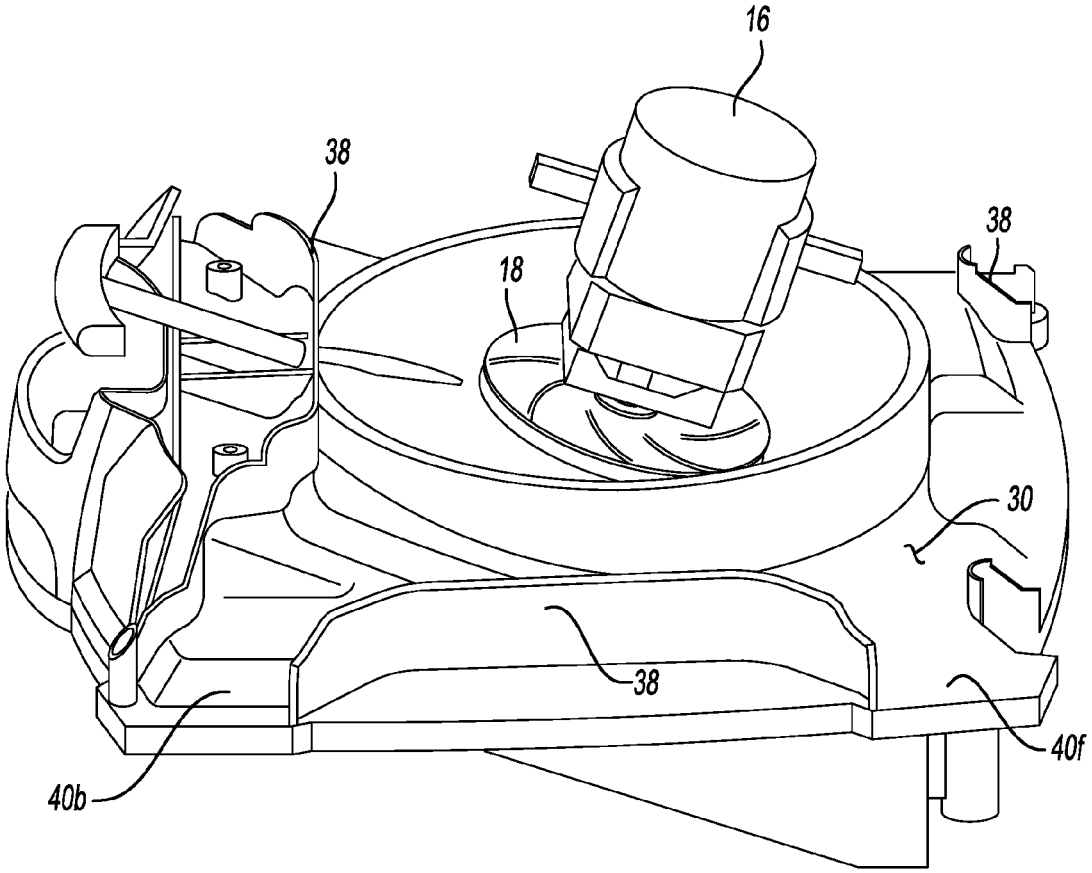
FIG. 7 is an upper perspective view of the upper panel of the fan chamber.
Figure 8:
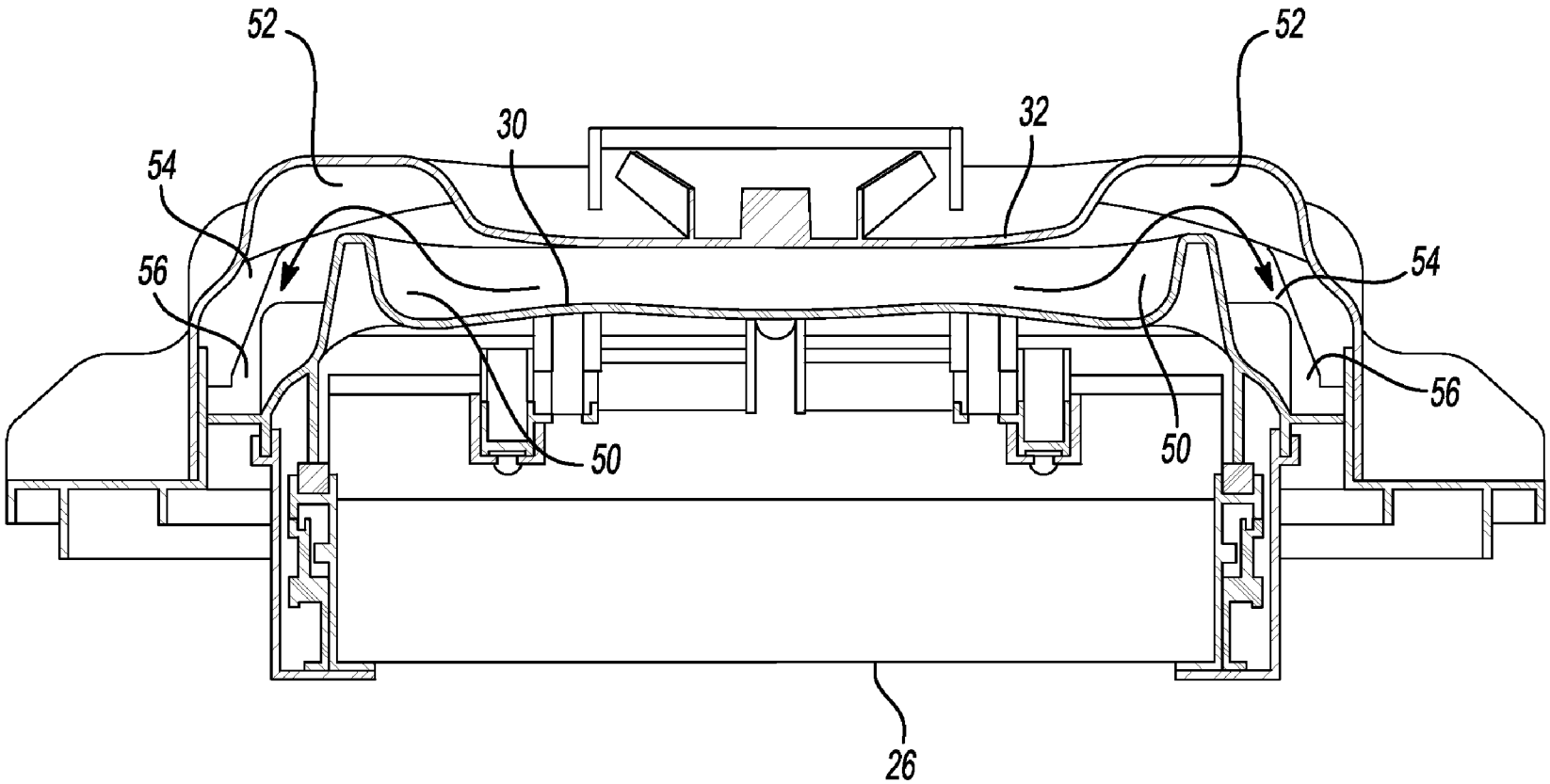
FIG. 8 is a partial cross-sectional view taken along line 8-8 of FIG. 6 showing the upper and lower panels of the fan chamber.
Figure 9:
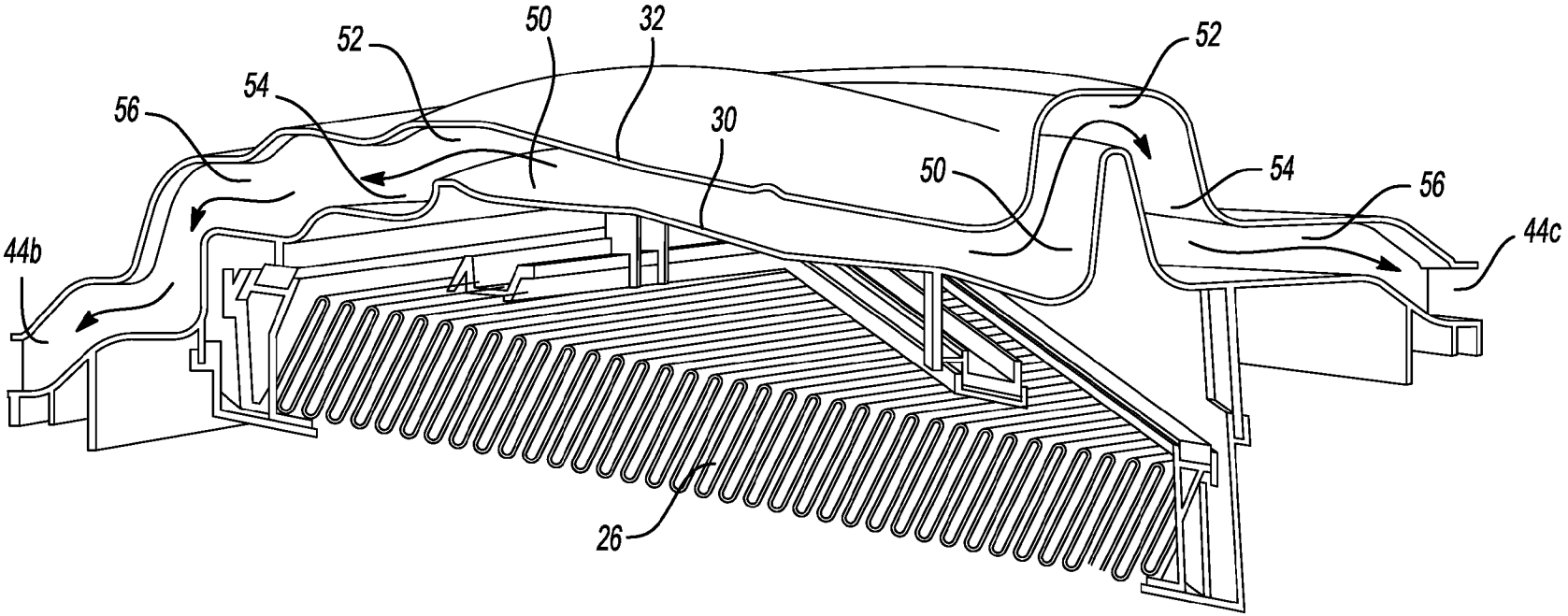
FIG. 9 is a diagonal cross-sectional view taken along line 9-9 of FIG. 6 showing the upper and lower panels of the fan chamber.

FIGS. 8 and 9 show cross-sectional views of the motor mount and the fan assembly taken along lines 8-8 and 9-9 of FIG. 6, respectively. When assembled, the internal walls of the upper panel 32 and the lower panel 30 form a series of chambers that extend radially outwardly from the fan recess and that enable exhaust air to flow from the fan impeller 18 in the fan chamber 20 to the exhaust ports 44*a-f*, as shown by the arrows in FIGS. 5, 8, and 9. Extending radially outwardly from the fan chamber 20 is a first chamber 50 that forces the air in a vertical direction relative to the fan chamber 20. Next, is a radially outer chamber 52 which causes the exhaust air to turn 90 degrees to again flow in a radial direction. Following the chamber 52 is a chamber 54 that again turns the air by 90 degrees so that it flows in a downward direction. Chamber 54 is followed by a chamber 56 that turn the air by 90 degrees so that the air flows to the exhaust ports 44*a-f*. By following this tortuous path, the exhaust air loses velocity, which reduces the noise from the exhaust. The chambers 50, 52, 54, 56 can have substantially constant or variable widths and heights around their circumference.

As shown in the drawings, the recess 34 and chambers 50, 52, 54, 56 are canted at an angle of approximately 20 degrees relative to the horizontal. Because of this, the annular wall extends only about 320 degrees around the fan mounting portion. Therefore, there is a blocking portion 60 near the front of the annular wall, which forces the air back toward one of the adjacent corner exhaust ports 44*a*, 44*b*.

The filter assembly 26 is slidably received within the filter housing 28 as illustrated in FIG. 2. As illustrated in FIG. 2, the insertion direction of the removable filter tray 26 can be disposed at an angle $\alpha_1$ which can be between 0 and 45 degrees relative to horizontal. Thus, the filter housing 28 of the vacuum head 14 may extend downward into the canister 12 at the filter housing's most inward end. The angled orientation of the filter tray assembly 26 thus allows the motor 16 and fan impeller 16 to be oriented such that the drive shaft 46 of the motor 16 is disposed at the angle $\alpha_2$ relative to vertical, as illustrated in FIG. 2. The angel $\alpha_2$ can be between 0 and 45 degrees relative to vertical, or if preferred, out of line. The angles $\alpha_1$ and $\alpha_2$ can be the same or approximately the same as one another although they can also be varied from one another. The angled orientation of the filter tray assembly 26, the electric motor 16, and impeller fan 18 allows the overall stack height of the motor, fan and filter to be reduced in the vertical direction in order to minimize the overall height of the vacuum 10.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A vacuum, comprising:

a housing;

a drive motor disposed in said housing;

a fan chamber disposed in said housing;

a fan impeller attached to said drive motor and disposed in said fan chamber;

an intake port extending into said housing; and an exhaust system in communication with said fan chamber, said exhaust system including a plurality of exhaust openings disposed on at least two external side surfaces of said housing, wherein said fan chamber is in communication with said plurality of exhaust openings via an intermediate chamber extending radially outward directly from said fan chamber, wherein said fan chamber and said intermediate chamber are defined directly between first and second panels positioned within said housing, which are positioned immediately adjacent said fan impeller and extend in a generally radially outward direction relative to a rotational axis of said fan impeller all of the way from said fan chamber to said exhaust openings.

2. The vacuum according to claim 1, wherein said plurality of exhaust openings are disposed on at least three sides of said housing.

3. The vacuum according to claim 1, wherein said plurality of exhaust openings are disposed at at least two corners of said housing.

4. The vacuum according to claim 1, wherein said intermediate chamber includes at least one section extending in an axial direction relative to an axis of rotation of said fan impeller and at least one radially extending section extending in a radial direction relative to the axis of rotation of said fan impeller.

5. The vacuum according to claim 1, wherein said housing includes a canister having a bottom surface and said first and second panels are canted at an angle of between 0 and 45 degrees from said bottom surface of said canister.

6. The vacuum according to claim 5, further comprising a filter cartridge disposed vertically below said first and second panels.

7. The vacuum according to claim 1, wherein said fan chamber communicates with a first axial chamber extending in an axial direction relative to an axis of rotation of said fan impeller that forces air in an axial direction relative to the the axis of rotation of said fan impeller.

8. The vacuum according to claim 7, wherein said first axial chamber communicates with a first radially outer chamber that forces air to turn radially outward relative to the first axial chamber.

9. The vacuum according to claim 8, wherein said first radially outer chamber communicates with a second axial chamber that forces air to turn in an axial direction relative to said first radially outer chamber.

10. The vacuum according to claim 9, wherein said second axial chamber communicates with a second radially outer chamber that forces air to turn radially outward relative to the second axial chamber and communicates with said plurality of exhaust openings in said housing.

11. The vacuum according to claim 1, wherein said housing includes a canister having a bottom surface and said drive motor has a drive shaft that is canted at an angle of between 45 and 90 degrees from said bottom surface.

12. A vacuum, comprising:

a housing;

a drive motor disposed in said housing;

a fan chamber disposed in said housing;

a fan impeller attached to said drive motor and disposed in said fan chamber;

an intake port extending into said housing; and an exhaust system in communication with said fan chamber, said exhaust system including a plurality of exhaust openings in said housing disposed on at least two external sides of said housing;

wherein said fan chamber is in communication with said plurality of exhaust openings via a radially extending chamber wherein said fan chamber and said radially extending chamber are defined directly between first and second panels positioned within said housing, which are positioned immediately adjacent said fan impeller and extend in a generally radially outward direction relative to a rotational axis of said fan impeller all of the way from said fan chamber to said plurality of exhaust openings, said radially extending chamber including at least one axially extending section extending axially relative to an axis of rotation of said fan impeller and at least one radially outwardly extending section extending radially relative to the axis of rotation of said fan impeller.

13. The vacuum according to claim 12, wherein said plurality of exhaust openings are disposed on at least three sides of said housing.

14. The vacuum according to claim 12, wherein said housing includes a bottom surface and said upper and lower panels are canted at an angle of between 0 and 45 degrees from said bottom surface.

15. A vacuum, comprising:

a housing;

a drive motor disposed in said housing;

a fan chamber disposed in said housing;

a fan impeller attached to said drive motor and disposed in said fan chamber;

an intake port extending into said housing; and an exhaust system in communication with said fan chamber, said exhaust system including a plurality of exhaust openings disposed on at least two external side surfaces of said housing;

wherein said fan chamber communicates with a first axial chamber that forces air in an axial direction relative to a center axis of the fan impeller, said first axial chamber communicates with a first radially outer chamber that forces air to turn radially outward relative to the center axis of the fan impeller from the first axial chamber, said first radially outer chamber communicates with a second axial chamber that forces air to turn in an axial direction relative to said center axis of the fan impeller from said first radially outer chamber, said second axial chamber communicates with a second radially outer chamber that forces air to turn radially outward relative to the center axis of the fan impeller from said second axial chamber and communicates with said plurality of exhaust openings in said housing, wherein said first and second axial chambers and said first and second radial chambers are defined directly between first and second panels positioned within said housing, which are positioned immediately adjacent said fan impeller and extend in a generally radially outward direction relative to a rotational axis of said fan impeller all of the way from said fan chamber to said exhaust openings.

* * * * *